US007895953B2

(12) United States Patent
Matus, Jr.

(10) Patent No.: US 7,895,953 B2
(45) Date of Patent: Mar. 1, 2011

(54) STRUCTURAL SUPPORT FOR A FOOD GUARD APPARATUS

(75) Inventor: Jose Orlando Matus, Jr., Gainesville, GA (US)

(73) Assignee: Elemental Ideas, L.L.C., Gainsville, GA (US)

( * ) Notice: Subject to any disclaimer, the term of this patent is extended or adjusted under 35 U.S.C. 154(b) by 983 days.

(21) Appl. No.: 11/406,982

(22) Filed: Apr. 19, 2006

(65) Prior Publication Data

US 2007/0090733 A1 Apr. 26, 2007

(51) Int. Cl.
*A47B 17/00* (2006.01)

(52) U.S. Cl. ..... 108/27; 108/60; 211/184

(58) Field of Classification Search ..... 108/27, 108/60, 90, 13, 57.12, 91, 23, 110, 180, 184, 108/153.1, 158.12, 155; 248/638, 611, 609, 248/562; 312/137; 211/184, 183
See application file for complete search history.

(56) References Cited

U.S. PATENT DOCUMENTS

| | | | | | |
|---|---|---|---|---|---|
| 1,378,400 | A | * | 5/1921 | Cook et al. | 312/137 |
| 2,486,966 | A | | 11/1949 | Mitchell | |
| 2,517,467 | A | | 8/1950 | Culver | |
| 2,876,053 | A | * | 3/1959 | Eves | 52/787.1 |
| 2,942,924 | A | * | 6/1960 | Stangert | 312/140.4 |
| D206,198 | S | * | 11/1966 | Molitor | D6/509 |
| 3,404,930 | A | | 10/1968 | Cafiero et al. | |
| 3,738,606 | A | | 6/1973 | Millen | |
| 3,921,539 | A | * | 11/1975 | Berger | 108/8 |
| 3,979,156 | A | * | 9/1976 | Gross | 312/196 |
| 4,013,880 | A | | 3/1977 | Kennedy, Jr. et al. | |
| 4,254,569 | A | * | 3/1981 | Janik | 40/606.15 |
| 4,403,554 | A | * | 9/1983 | Valentine et al. | 108/23 |
| 4,572,598 | A | | 2/1986 | Moore, Jr. | |
| 4,576,353 | A | * | 3/1986 | Valeria | 108/155 |
| 5,082,334 | A | | 1/1992 | Beyer et al. | |
| 5,176,274 | A | * | 1/1993 | Jenkins | 108/43 |
| 5,213,401 | A | | 5/1993 | Hatcher | |
| 5,306,077 | A | | 4/1994 | Trevaskis | |
| 5,584,545 | A | | 12/1996 | LaVaute et al. | |
| 5,803,276 | A | * | 9/1998 | Vogler | 211/184 |
| 5,823,102 | A | | 10/1998 | Will | |
| 6,101,954 | A | | 8/2000 | Rein et al. | |
| 6,132,018 | A | | 10/2000 | McGrath | |
| 6,485,118 | B2 | | 11/2002 | Matus, Jr. | |
| 6,588,863 | B1 | * | 7/2003 | Yatchak et al. | 312/140.4 |

(Continued)

FOREIGN PATENT DOCUMENTS

DE 3907597 A1 4/1990

OTHER PUBLICATIONS

Advertisement Brochure—Z Guard, Brass Smith Incorporated, 1999, pp. 1-4.

*Primary Examiner*—José V Chen
(74) *Attorney, Agent, or Firm*—Daniel J. Santos

(57) ABSTRACT

A structural support for supporting a food guard shield includes first and second spaced apart sheet-like arms and at least one spacer positioned between the sheet-like arms. The first and second sheet-like arms can be securely connected to each other or to the at least one spacer to form a substantially rigid structure for supporting the food guard shield. The support can have a variety of shapes, including shapes resembling alphanumeric character and logos.

16 Claims, 8 Drawing Sheets

U.S. PATENT DOCUMENTS 6,820,908 B1 * 11/2004 Tousi et al. ..... 248/609
7,040,723 B2 5/2006 Matus, Jr.
7,150,236 B1 * 12/2006 Riley ..... 108/43
D543,740 S * 6/2007 Hartsfield et al. ..... D6/509
2005/0229823 A1 * 10/2005 Weatherly et al. ..... 108/182

* cited by examiner

STRUCTURAL SUPPORT FOR A FOOD GUARD APPARATUS

CROSS REFERENCE TO RELATED APPLICATIONS

This application claims priority to U.S. Provisional Patent Application Ser. No. 60/730,218, filed Oct. 25, 2005, which is hereby incorporated herein by reference in its entirety for all purposes.

TECHNICAL FIELD

The present invention relates generally to the field of food guard apparatuses and methods of construction thereof, and more particularly to structural supports for food guard apparatuses.

BACKGROUND OF THE INVENTION

Food guard apparatuses, also sometimes referred to as food protectors, food shields, sneeze guards, food guards, breath shields, or counter protectors, are required by law to protect or cover open or exposed food in a public establishment with a panel, typically a transparent panel constructed of tempered glass or clear acrylic, so as to intercept the breath from the consumer.

Generally, the food guard apparatuses take one of two basic forms. First, the food guard can be constructed of a single vertical, transparent panel or food shield, which may or may not be connected to an upper shelf. Such design is typically used for stations where food is handed to a consumer by a server. Second, the food guard can be constructed of an angled transparent panel, with or without an upper shelf, as typically used with self-serving stations, salad bars, and buffets.

Such food protectors or food guard apparatuses typically have supporting structures, frames, and/or posts for supporting the food shield. Some such structures can include hollow tubing that is round, square, oval, elliptical, rectangular, slotted, notched or hexagonal shaped. Other such structures can include solid bars or rods having a round, square, oval, elliptical, rectangular or hexagonal shape. Still other such structures can include cable, chain, or wire, either suspended or tensioned to support the food shield. And still other support structures can be constructed of steel, aluminum, or stainless plate material having a substantial thickness of about a half-inch or more.

Additionally, the food guard apparatuses typically have a limited distance in between vertical supports, and thus, the transparent food shield cannot span long distances (such as spanning the length of long counters) without additional supports. Typically, ¼", ⅜", or ½" tempered glass is the shielding material used for the transparent panels of the food guards. The limitation as to how far the tempered glass can span generally is dependent on the thickness of glass. For example, ¼ glass will typically deflect and bend over a 42" span, whereas ⅜" glass will typically deflect and bend over a 54" span. Half inch tempered glass will typically deflect and bend over a 60" inch span. This deflection or bowing of the glass can generally be alleviated by supporting the glass along its longitudinal plane or by adding center support structures. To support the glass along its longitudinal plane, typically a beam comprising a tubular structure, or a tubular square structure, having a minimum diameter of about 1 ½ inches is used. In some cases, the horizontal beam is 2 or 3 inches in diameter. Thus, the added horizontal beam can create a sort of "framing" around the glass, which can be unsightly and can block the view of the food being protected.

Fabrication of such structures, frames, and/or posts can be time-consuming and expensive. Also, some structures, frames, and posts have a handedness to them such that separate structures, frames and posts are fabricated depending on the position of the structure relative to the shield (i.e., left, right or center structures). Therefore, a need exists in the industry for an apparatus and method which would allow for inexpensive fabrication of structural supports for food guard apparatuses and which would avoid the handedness typically associated with such supports.

SUMMARY OF THE INVENTION

In an example form, the present invention is a structural support for a food guard apparatus. The structural support has first and second spaced apart sheet-like arms coupled together with at least one spacer positioned between the sheet-like arms. The first and second sheet-like arms are securely connected to each other or to the at least one spacer to form a substantially rigid structure. Preferably, the at least one spacer includes a plurality of spacers. The structural support can have a variety of sizes and shapes, including shapes in the form of an elongated post, a logo, and an alphanumeric character such as a generally elongated A-shape, a generally oblique T-shape, and a generally L-shape.

In another aspect, the present invention is an apparatus for supporting a food guard. The apparatus includes a first thin panel and a second thin panel spaced apart from the first thin panel by a plurality of connectors. The first and second thin panels are securely connected to the connectors or to each other to form a substantially rigid support for the food guard. Preferably, the plurality of connectors space apart the first and second thin panels a distance which is at least an order of magnitude greater than the thickness of the thin panels. Also preferably, each sheet-like arm has a thickness of about 0.020 inch to about 0.125 inch. The apparatus can have a variety of sizes and shapes. Exemplary shapes include an elongated frame, a logo, and an alphanumeric character such as a generally elongated A-shape, a generally oblique T-shape, and a generally L-shape.

In another aspect, the invention is a food guard apparatus comprising a transparent panel, first and second vertical structural supports for supporting the transparent panel, and a horizontal brace which spans the distance between the first and second vertical structural supports and securely attaches to both vertical supports and the transparent panel. Each vertical structural support preferably includes first and second spaced apart sheet-like arms and a plurality of spacers positioned between the sheet-like arms. The first and second sheet-like arms are securely connected to each other or to the plurality of spacers to form a substantially rigid structure for supporting the transparent panel. The horizontal brace preferably includes first and second spaced apart thin panels and a plurality of connectors positioned between the thin panels. The first and second thin panels are securely connected to each other or to the plurality of connectors to form a substantially rigid structure for supporting the transparent panel. The horizontal brace is securely attached to the transparent panel at a point that is approximately the midpoint between the distance between the two vertical supports.

Advantageously, the structural supports of the present invention provide a rigid support structure for a food guard apparatus that is inexpensive to manufacture. By coupling a pair of sheet-like arms together with a plurality of spacers to form a rigid support, the amount of material for the support is decreased, which in turn decreases the cost of the support. Moreover, the manufacturing of the supports is simplified, as the sheet-like arms can be laser cut, for example, from sheet material and then assembled together with a plurality of spacers and fasteners. Additionally, such sheet-like arm design can eliminate the handedness typically associated with conventional supports posts for food guard apparatuses. Moreover, the structural supports can have shapes that allow them to be used for multiple functions (such as a shape that provides support for both a vertical shield and shelf in one embodiment and provides support for an angled shield in another).

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DESCRIPTION OF EXEMPLARY EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
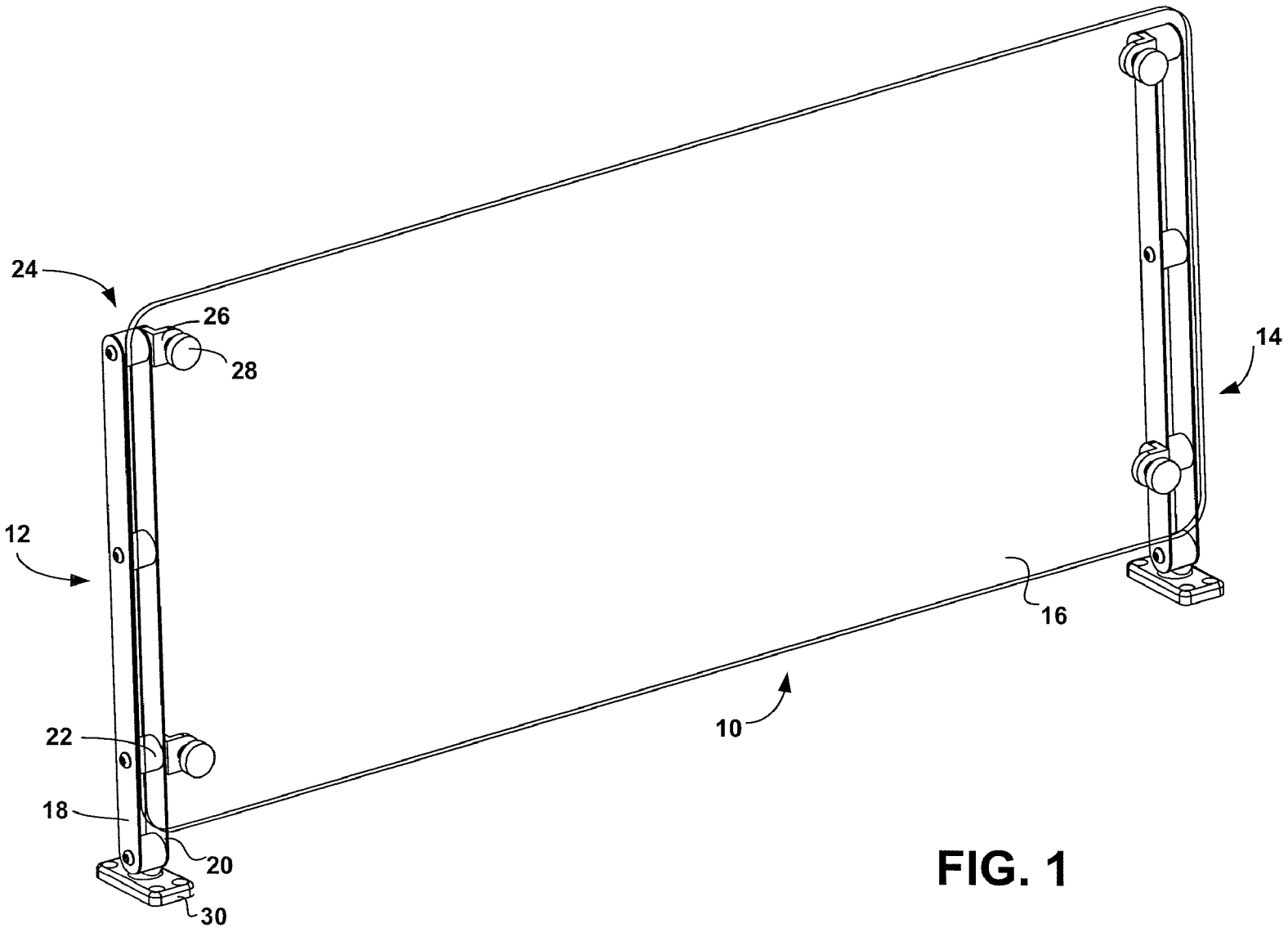
FIG. 1 is a perspective view of a food guard apparatus supported by a pair of structural supports having sheet-like panels in accordance with a first preferred form of the present invention.

Referring to FIG. 1, a food guard apparatus 10 is shown according to principles of the present invention. The food guard apparatus 10 includes two structural supports, posts, or members 12 and 14 for supporting a food shield or panel 16. The food shield 16 can be a transparent or substantially transparent panel constructed of tempered glass, Plexiglas, or clear acrylic, for example, and such food shields are generally well known in the industry.

The support 14 includes elements substantially similar to those of the support 12, and thus only the support 12 will be described herein. The support 12 includes sheet-like arms or thin panels 18 and 20 spaced apart by one or more spacers, cross pins, connectors, or ribs, 22. Preferably, four or more spacers 22 space apart each pair of sheet-like arms 18 and 20, although those skilled in the art will understand that any number of spacers, including one, two, three, four, or more spacers can be used without deviating from the scope of the present invention. The sheet-like arms 18 and 20 can be securely connected to each other with, for example, conventional fasteners or fastening techniques, such that the spacers 22 function much like washers. Alternatively, the sheet-like arms 18 and 20 are securely connected to the spacers 22 by, for example, metal adhesives, welding, soldering, mechanical fastening, or other conventional fastening techniques or fasteners.

Figure 2A:
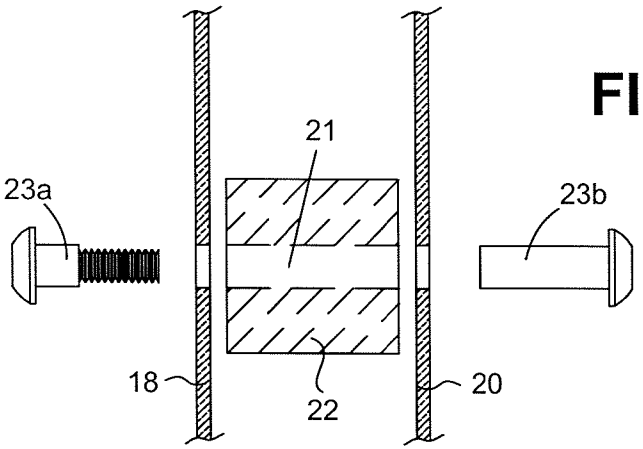
FIGS. 2A, 2B, and 2C are schematic views of how the sheet-like panels of the structural supports of FIG. 1 can be attached to one another, with a spacer positioned therebetween.
Figure 2B:
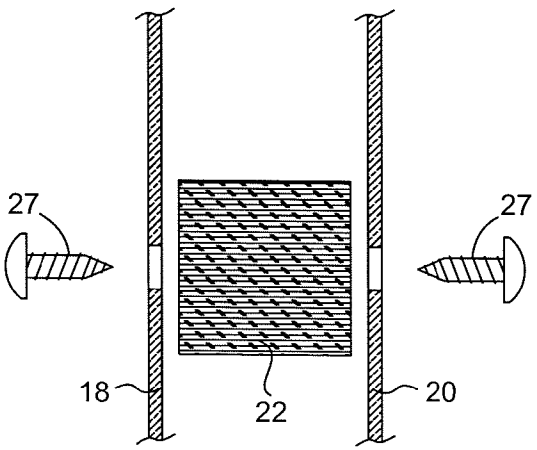
Figure 2C:
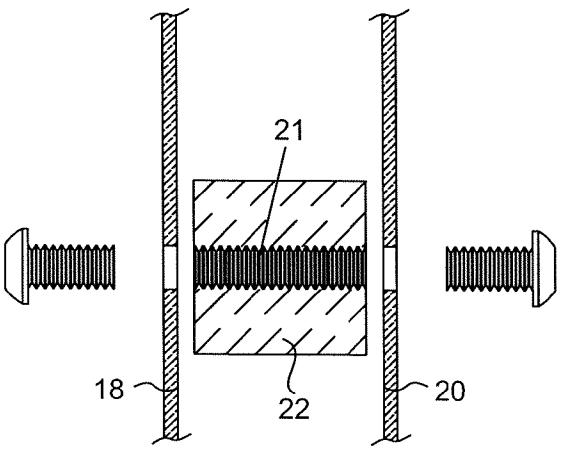

FIG. 2A schematically shows how the sheet-like panels 18 and 20 can be attached to one another, with the spacer 22 positioned therebetween, and this construction is typical throughout the supports 12 and 14. The panels and the spacers bear fastener holes for receiving fasteners. One such fastener is shown in FIG. 2A as a screw 23A and a corresponding nut 23B. The screw 23A and nut 23B are inserted through a smooth bore 21 of a rigid spacer 22 and securely fasten the panels to each other, forming a rigid sandwich assembly with the spacer flanked by the panels. Here the sheet-like arms 18 and 20 are shown to be sheet metal, such as aluminum or steel sheet metal, and the spacers 22 are shown as being constructed of a rod of material substantially similar to the sheet metal of the sheet-like arms 18 and 20. For example, the spacer 22 can be a rod of aluminum or stainless steel. Those skilled in the art will understand that metals and other rigid materials can be used for the spacer 22. Alternatively, the spacers 22 can be constructed of a resilient element, such as plastic, wood, or rubber. Moreover, while FIG. 2A depicts the panels as fastened to each other about the spacer, FIG. 2B depicts the panels as fastened each to the spacer. As shown in FIG. 2B, tapered screws 27 can be threaded through the sheet-like arms 18 and 22 and into the spacer 22, thereby securing the panels to the spacer. Alternatively as shown in FIG. 2C, the panels 18 and 20 can be fastened to the spacer 22 by a pair of machine screws that are threaded into a threaded bore 21 of the spacer 22, thereby securing the panels to each other.

Preferably, the plurality of spacers 22 space apart the sheet-like arms 18 and 20 a distance which is at least an order of magnitude greater than the thickness of the sheet-like arms. Preferably, the sheet-like arms 18 and 20 are spaced apart by about one inch. Those skilled in the art will understand that such spacing is exemplary and that the spacing can be smaller or larger. For example, the spacing between the arms 18 and 20 can be about a half of an inch to about several feet.

Preferably, each sheet-like arm 18 and 20 is constructed from a durable sheet material, such as but not limited to, stainless steel, brass, copper, aluminum sheet metal, or plate material. The thickness of the sheet-like arms 18 and 20 can vary, and in one embodiment, the thickness of the sheet-like material can be about 0.020 of an inch to about 0.50 of an inch. Preferably, in an exemplary embodiment, the thickness is about 0.050 to about 0.25 of an inch, although the thickness can be larger or smaller. Most preferably, the thickness is about 0.050 to about 0.125 of an inch thick. When the sheet-like arms 18 and 20 are connected together with the spacers 22, the sheet-like arms form a rigid support 12 that resists buckling and bending in the horizontal direction.

The support 12 also includes at least one, and preferably, a plurality of mounting assemblies 24 to mount the shield 16 to the support. As shown in the drawings, two mounting assemblies 24 are used to connect the food shield 16 to the support 12, although those skilled in the art will understand that any number of mounting assemblies can be used. Preferably, each mounting assembly 24 is located at a spacer so that the mounting assembly is securely fastened to both sheet-like arms 18 and 20. Preferably, each mounting assembly 24 includes a mounting bracket 26 attached to both sheet-like arms 18 and 20 and a fastener 28 extending therethrough for securely attaching the shield 16 to the mounting bracket of the support. Preferably, the mounting bracket 26 is constructed of the same or similar material as the material of the sheet-like arms 18 and 20 so as to maintain uniformity in the appearance of the food guard apparatus 10. However, those skilled in the art will understand that various other durable materials can be used for the mounting bracket. The fasteners 28 can be removable fasteners, such as bolts, screws and the like. Alternatively, the shield 16 can be fastened to the support with a more permanent fastening technique such as gluing and bonding. Those skilled in the art will understand that various mounting assemblies, brackets, fasteners, and fastening techniques, including those described in U.S. Patent Publication No. 2003/0047086 of Matus, which is incorporated by reference herein in its entirety for all purposes, can be employed as well without deviating from the scope of the present invention.

The supports 12 and 14 can be coupled with conventional bracketing or feet 30, and secured to a counter, floor, wall, ceiling, or food tray, so as to construct a frame for the food guard apparatus 10. Exemplary feet are shown in U.S. Patent Publication No. 2005/0150388 of Matus, which is incorporated by reference herein in its entirety for all purposes, although those skilled in the art will understand that various other feet or bracketing can be used without deviating from the scope of the present invention. Those skilled in the art will also understand that various fasteners and fastening techniques can be used to secure the supports 12 and 14 of the food guard apparatus 10 to a support surface, with or without feet for the supports, and still be within the scope of the present invention. Thus, the sandwiched support structure of the sheet-like arms 18 and 20 and the spacers 22, coupled with a number of mounting assemblies 24 and a transparent panel or a food shield 16 thereby form the food guard apparatus 10.

Figure 3:
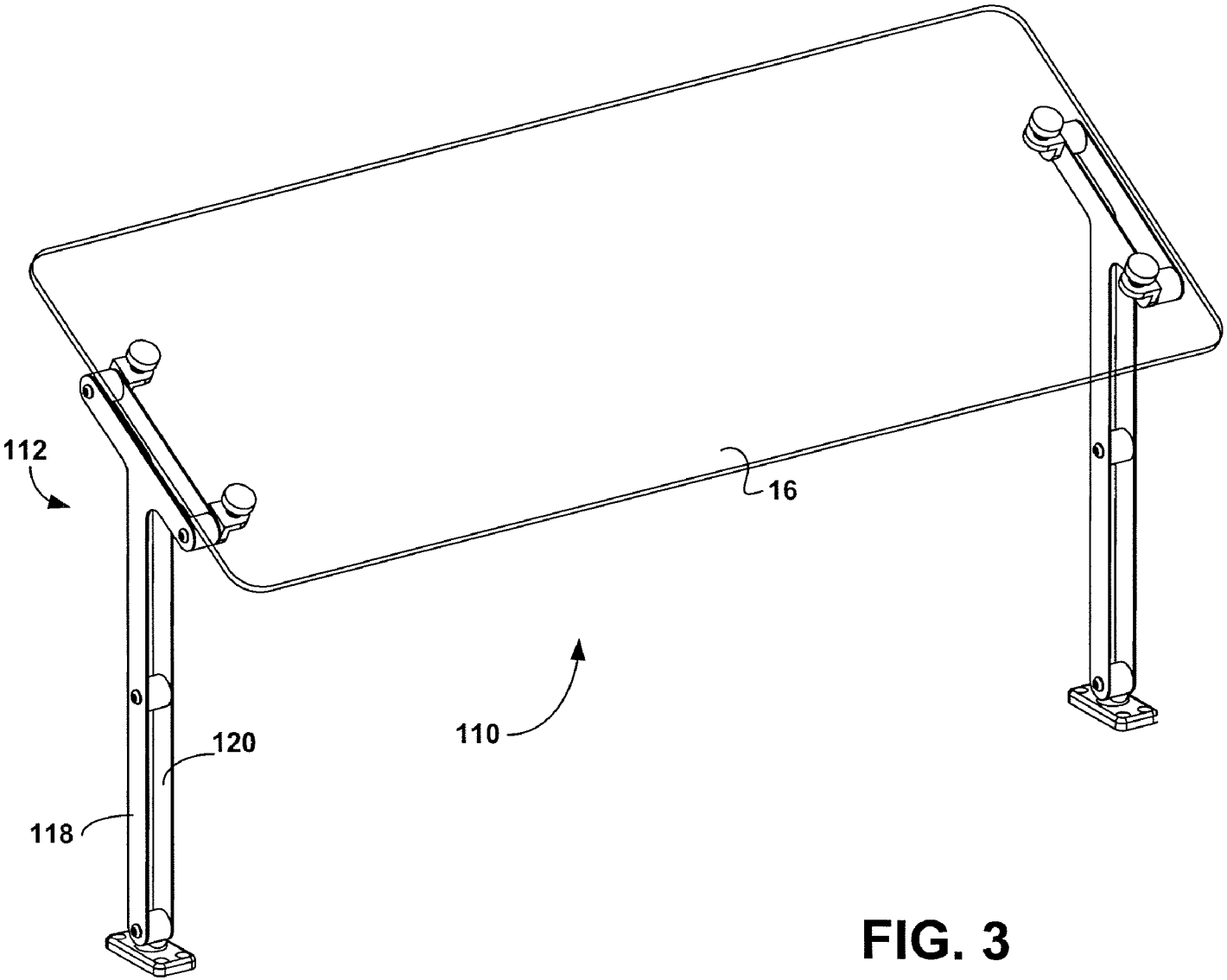
FIG. 3 is a perspective view of a food guard apparatus supported by a pair of structural supports in accordance with a second preferred form of the present invention.
Figure 4:
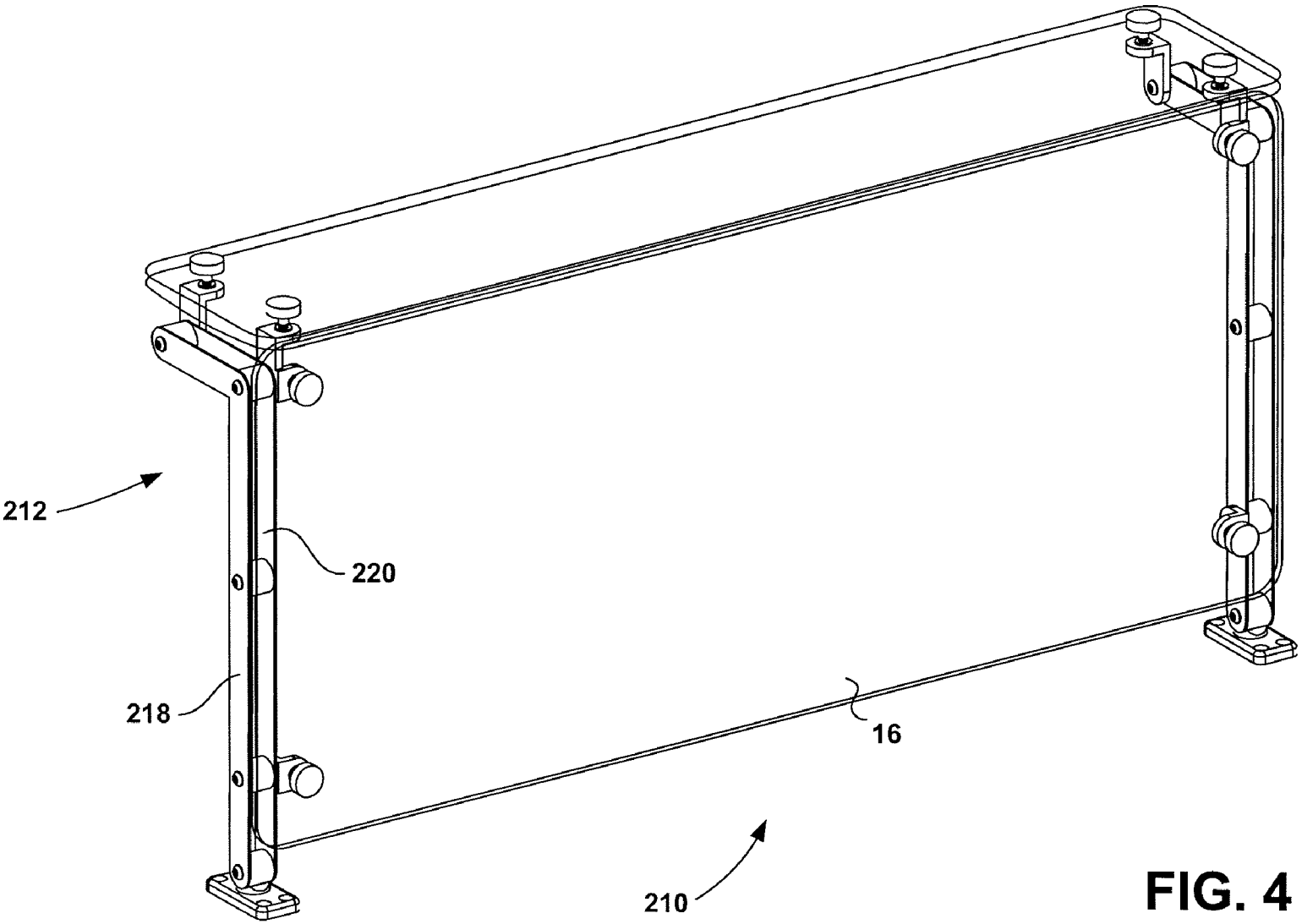
FIG. 4 is a perspective view of a food guard apparatus supported by a pair of structural supports in accordance with a third preferred form of the present invention.
Figure 5:
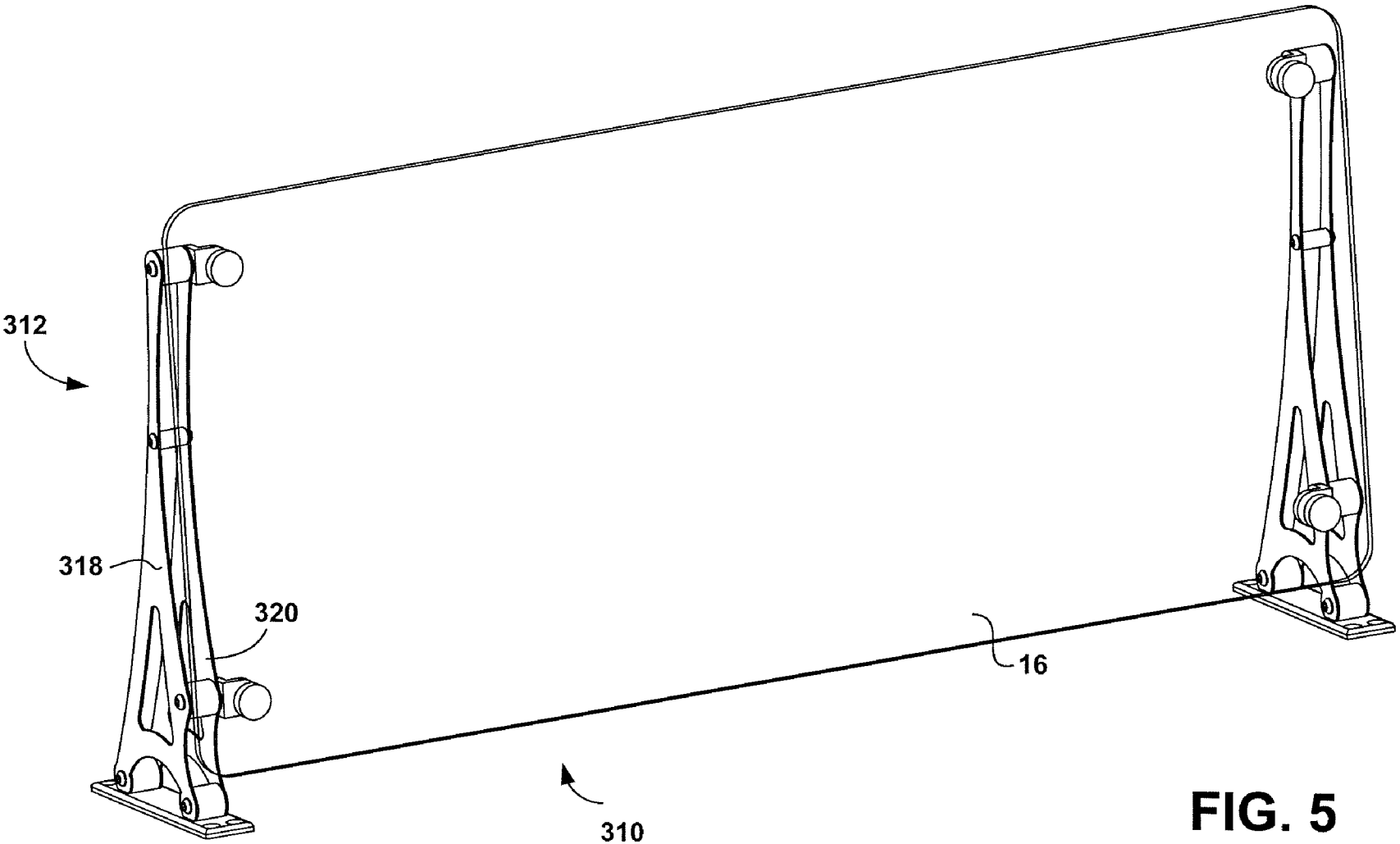
FIG. 5 is a perspective view of a food guard apparatus supported by a pair of structural supports in accordance with a fourth preferred form of the present invention.
Figure 6:
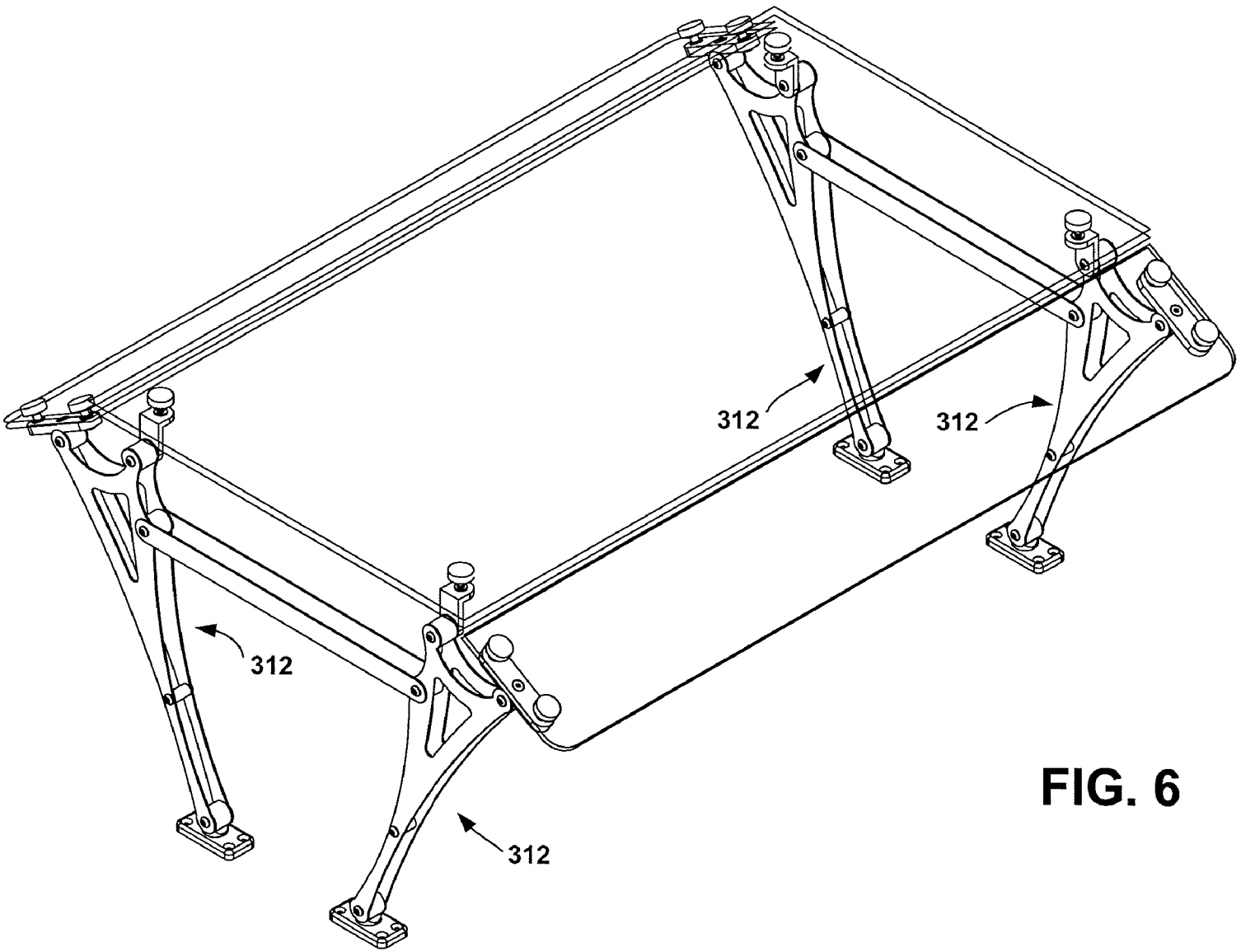
FIG. 6 is a perspective view of the structural supports of FIG. 5 in another orientation.
Figure 7:
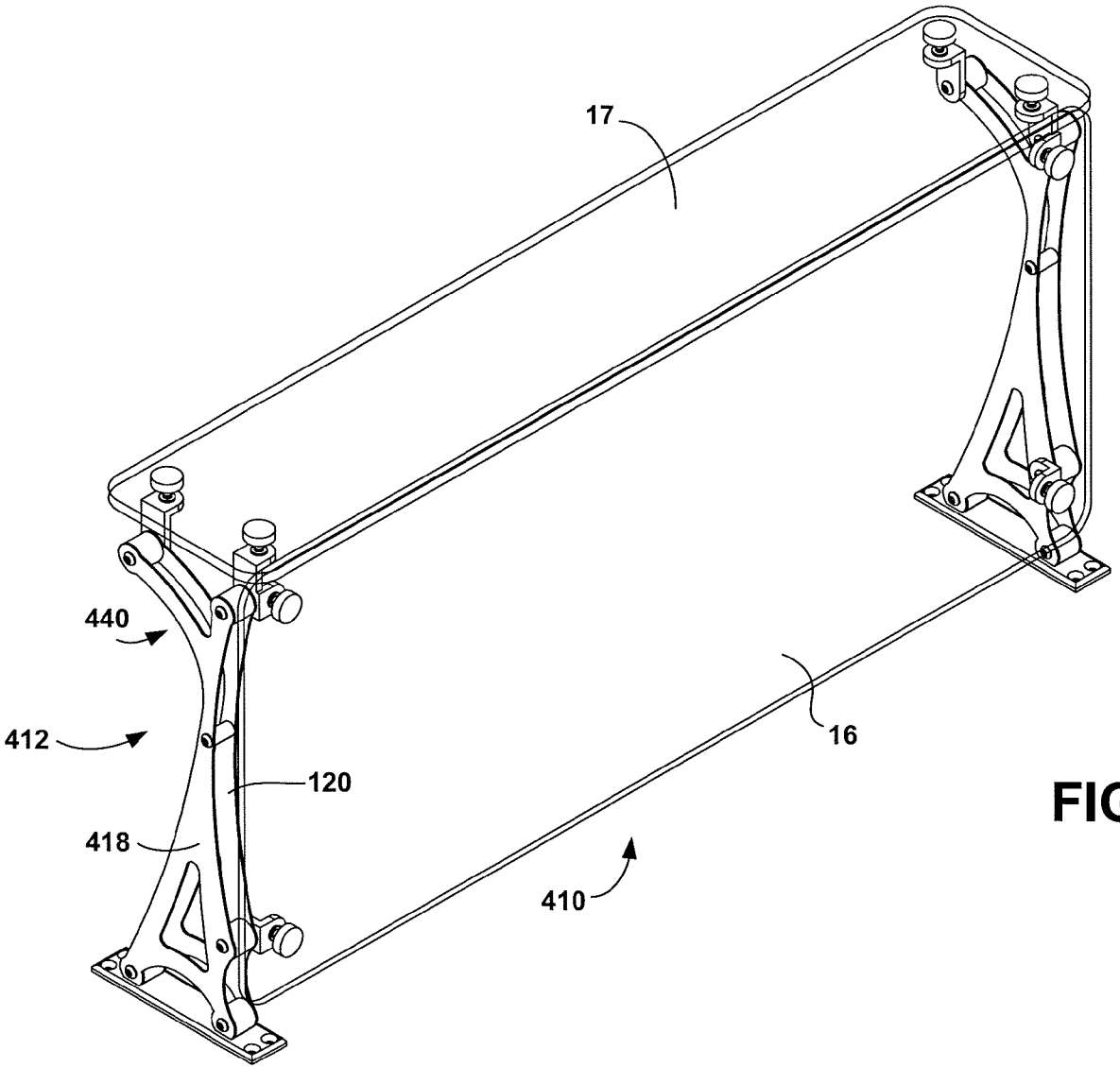
FIG. 7 is a perspective view of a food guard apparatus supported by a pair of structural supports in accordance with a fifth preferred form of the present invention.

As shown in FIGS. 1-7, the supports 12 and 14 can have various shapes and sizes. FIG. 1 shows generally straight or linear elongated sheet-like arms that form a generally rectangular shaped support 12 for supporting a vertical food shield. FIG. 3 shows another embodiment of the support 112. The support 112 has generally oblique T-shaped sheet-like arms 118 and 120 for supporting an angled food shield 16. FIG. 4 shows yet another embodiment of the support 212. The support 212 has generally L-shaped sheet-like arms 218 and 220 for supporting the vertical food shield 16, as well as a horizontal food shield 17. FIG. 5 shows a generally elongated A-shaped support 312 having arms 318 and 320 for supporting a vertical food shield 16. FIG. 6 shows a plurality of the generally elongated A-shape supports 312 of FIG. 4 rearranged to support a plurality of food shields. FIG. 7 shows a generally elongated A-shaped support 412 having arms 418 and 420 for supporting an upright food shield 16 along with a curved extender 440 for supporting a horizontal food shield 17.

Those skilled in the art will understand that such shapes depicted in FIGS. 1-7 are merely exemplary and that the supports 12 and 14 can have any of a variety of shapes. For example, the supports can have a shape resembling an alphanumeric character or other character such as, but not limited to, a character in a foreign language. Alternatively, the supports can have a shape in the form of a company logo. For example, the shape depicted in FIG. 5 could be the shape of a logo for a particular company. Moreover, the supports can have shapes resembling geometric shapes or any other object. Or, the supports can be generally elongated supports, as depicted in FIG. 1, with voids therein. The voids can take the form of letters or words (such as company names or other phrases), logos, or any other ornamental design.

Figure 8:
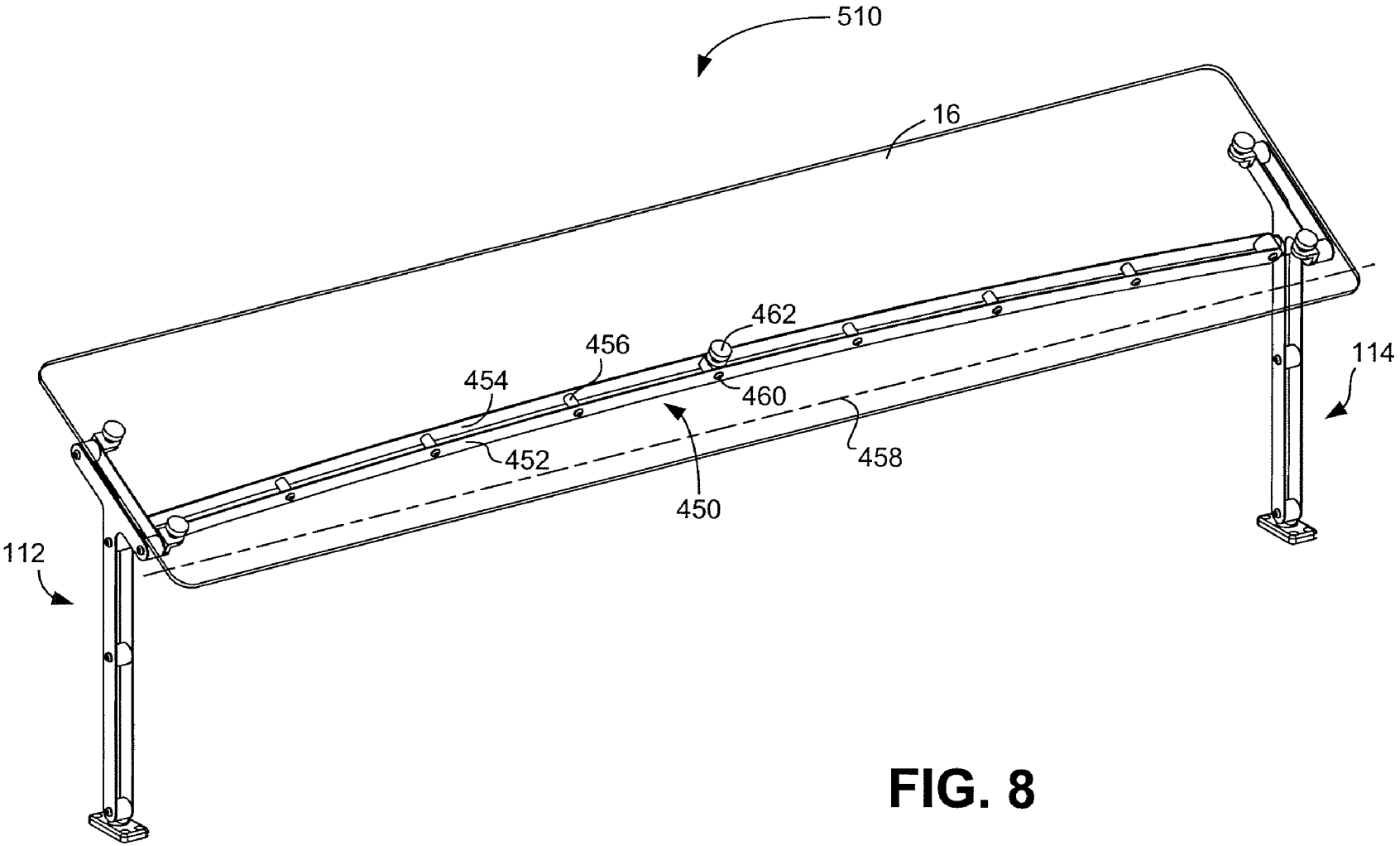
FIG. 8 is a perspective view of a food guard apparatus supported by a pair of vertical supports and a horizontal support in accordance with a sixth preferred form of the present invention.

FIG. 8 shows a food guard apparatus 410 supported by a pair of vertical supports 112 and 114 and a horizontal brace or support 450 according to a sixth preferred form of the present invention. The horizontal brace 450 spans the distance between the two vertical supports 112 and 114 and connects to both vertical supports. The horizontal brace 450 includes two sheet-like arms 452 and 454 spaced apart by a plurality of spacers 456. The sheet-like arms 452 and 454 and the spacers 456 of the horizontal brace 450 are constructed of materials substantially similar to those of the vertical supports and are constructed in the same or similar manner as that of the vertical support so as to maintain a uniformity in look. In the depicted embodiment, the horizontal brace 450 has a slight curve in shape, but those skilled in the art will understand that straight braces and braces of other shapes and sizes can be used as well. Additionally, the horizontal brace 450 preferably does not substantially block the view of the food being protected by the shield 16.

As shown in FIG. 8, the food shield 16 defines a longitudinal axis 458 extending therethrough. Preferably, the horizontal brace 450 is generally parallel to the longitudinal axis 458 and attaches to both vertical supports 112 and 114 as well as attaches to the food shield 16 at a point 460 that is approximately the midpoint between the two vertical supports with one or more fasteners 462. However, those skilled in the art will realize the connection point to the glass does not have to be the midpoint, as the connection point can be anywhere along the length of the brace 450. Moreover, the brace 450 may connect to the shield 16 at more than one point. Those skilled in the art will understand that the brace 450 can have various other configurations and can be attached at various points on the shield 16 and vertical supports 112 and 114. Moreover, those skilled in the art will further understand how and where to connect the horizontal brace 450 to the transparent shield 16 and to the vertical supports 112 and 114 so as to provide adequate support, which minimizes or eliminates deflection or bending in the glass.

The fasteners 462 can be removable fasteners, such as bolts, screws and the like. Alternatively, the shield 16 can be fastened to the brace 450 with a more permanent fastening technique such as gluing and bonding. Those skilled in the art will understand that various mounting assemblies, brackets, fasteners, and fastening techniques can be employed as well without deviating from the scope of the present invention.

While the invention has been described with reference to preferred and example embodiments, it will be understood by those skilled in the art that a variety of modifications, additions and deletions are within the scope of the invention, as defined by the following claims.

What is claimed is:

1. A food guard apparatus, comprising:

first and second structural supports, the structural supports each comprising:

first and second sheet-like components, each having an inner and an outer surface, spaced apart in substantially parallel planes such that the inner surfaces of the sheet-like components face one another, wherein each of the sheet-like components comprise at least one through-hole;

at least one spacer positioned between, and in mechanical communication with, the inner surfaces of the sheet-like components and fully contained within boundaries of a space defined between the inner surfaces of the sheet-like components, wherein the at least one spacer comprises a bore that defines an axis substantially perpendicular to the parallel planes of the sheet-like components; and at least one fastener, wherein the at least one fastener is configured to mechanically couple said at least one spacer between the first and second sheet-like components, when commonly positioned through the bore of the spacer and said at least one through-hole of each of the sheet-like components;

two or more connection devices mechanically coupled to the outer surfaces of the first sheet-like components of the first and second structural supports, wherein each connection device further comprises a panel fastener component positioned along an axis of the connection device that is substantially parallel to the plane of the respective first sheet-like component; and a transparent panel mechanically coupled to the first and second structural supports via the panel fastener component of each of the two or more connection devices, wherein the transparent panel defines a plane substantially perpendicular to both the axes of the connection devices and the parallel planes of the sheet-like components.

2. The apparatus of claim 1, wherein the at least one spacer further comprises a plurality of spacers.

3. The apparatus of claim 1, wherein the spacers are constructed of a material at least substantially similar to that of the sheet-like components.

4. The apparatus of claim 1, wherein the spacers are constructed of a material different than a material used for the sheet-like components.

5. The apparatus of claim 1, wherein the sheet-like components of at least one structural support have a shape resembling an alphanumeric character.

6. The apparatus of claim 1, wherein the sheet-like components of at least one structural support have a shape of a logo.

7. The apparatus of claim 1, further comprising a horizontal brace connected to and spanning the distance between the first and second structural supports, wherein the horizontal brace is configured to support the transparent panel.

8. The apparatus of claim 7, wherein the horizontal brace is mechanically coupled to the transparent panel at a point that is approximately midway between the first and second structural supports.

9. An apparatus for supporting a food shield, comprising:

first and second thin panels, each having an inner and an outer surface, spaced apart in substantially parallel planes such that the inner surfaces of the thin panels face one another, wherein each of the thin panels comprise at least one through-hole;

a plurality of spacers positioned between, and in mechanical communication with, the inner surfaces of the thin panels and fully contained within boundaries of a space defined between the inner surfaces of the thin panels, wherein each of the plurality of spacers comprise a bore that defines an axis substantially perpendicular to the parallel planes of the thin panels; and a plurality of fasteners, wherein each of the plurality of fasteners is configured to mechanically couple said one of the plurality of spacers between the first and second thin panels, when commonly positioned through the bore of the spacer and said at least one through-hole of each of the thin panels; and one or more connection devices mechanically coupled to the outer surface of the first thin panel, wherein each connection device further comprises a food shield fastener component positioned along an axis of the connection device that is substantially parallel to the plane of said first thin panel;

wherein the food shield fastener component is configured to mechanically receive a food shield such that the food shield is support by the apparatus.

10. The apparatus of claim 9, wherein the plurality of spacers space apart the first and second thin panels a distance which is at least an order of magnitude greater than the thickness of the thin panels.

11. The apparatus of claim 9, wherein each panel has a thickness of about 0.020 inch to about 0.125 inch.

12. The apparatus of claim 9, wherein the apparatus is an elongated frame.

13. The apparatus of claim 9, wherein the thin panels of the apparatus have a shape resembling an alphanumeric character.

14. The apparatus of claim 9, wherein the thin panels of the apparatus have a shape of a logo.

15. A food guard system, comprising:

a transparent panel;

one or more structural supports operable to support the transparent panel, the one or more structural supports each comprising:

one or more panel coupling devices, wherein the panel coupling devices are configured to mechanically receive the transparent panel;

first and second spaced apart thin panels, wherein the first and second panels define substantially parallel planes; and a plurality of spacers positioned between the thin panels and fully contained within boundaries of a space defined by the thin panels, wherein the first and second thin panels are securely connected to each other via a series of fasteners and the plurality of spacers to form a substantially rigid structure operable to support the transparent panel when mechanically received by the one or more panel coupling devices;

wherein, when mechanically received by the one or more panel coupling devices, the transparent panel defines a plane that is substantially perpendicular to the parallel planes defined by the first and second spaced apart thin panels.

16. The food guard system of claim 15, wherein the material used to construct the sheet-like arms and spacers of the vertical supports is substantially similar to the material used to construct the thin panels and connectors of the horizontal brace.

* * * * *